US007699103B2

(12) United States Patent
Den Boer et al.

(10) Patent No.: US 7,699,103 B2
(45) Date of Patent: Apr. 20, 2010

(54) METHOD AND SYSTEM FOR INSERTING A FIBER OPTICAL SENSING CABLE INTO AN UNDERWATER WELL

(75) Inventors: Johannis Josephus Den Boer, Rijswijk (NL); Kari-Mikko Jääskeläinen, Houston, TX (US)

(73) Assignee: Shell Oil Company, Houston, TX (US)

( * ) Notice: Subject to any disclaimer, the term of this patent is extended or adjusted under 35 U.S.C. 154(b) by 567 days.

(21) Appl. No.: 11/631,736

(22) PCT Filed: Jul. 6, 2005

(86) PCT No.: PCT/EP2005/053222

§ 371 (c)(1),
(2), (4) Date: Jan. 5, 2007

(87) PCT Pub. No.: WO2006/003208

PCT Pub. Date: Jan. 12, 2006

(65) Prior Publication Data

US 2008/0314579 A1 Dec. 25, 2008

(30) Foreign Application Priority Data

Jul. 7, 2004 (EP) ..... 04103210

(51) Int. Cl.
*E21B 47/00* (2006.01)

(52) U.S. Cl. ..... 166/250.01; 166/342; 166/66; 166/77.1; 166/242.2; 340/854.7

(58) Field of Classification Search ..... 166/342, 166/250.01, 65.1, 66, 77.1, 242.2; 340/854.7
See application file for complete search history.

(56) References Cited

U.S. PATENT DOCUMENTS

| | | | | |
|---|---|---|---|---|
| 5,438,860 | A | 8/1995 | Kawai et al. | 73/7 |
| 5,570,437 | A | 10/1996 | Kluth et al. | 385/12 |
| 6,185,351 | B1 * | 2/2001 | Daneshvar et al. | 385/114 |
| 6,644,402 | B1 | 11/2003 | Sharma et al. | 166/250.01 |
| 6,828,547 | B2 * | 12/2004 | Tubel et al. | 250/227.14 |

(Continued)

FOREIGN PATENT DOCUMENTS

| | | |
|---|---|---|
| GB | 2179471 | 3/1987 |
| JP | 2001 124529 | 5/2001 |
| WO | 2004005968 | 1/2004 |
| WO | 2005014976 | 2/2005 |

*Primary Examiner*—William P Neuder
*Assistant Examiner*—Nicole A Coy

(57) ABSTRACT

A fiber optical sensing cable is inserted into an underwater well by: connecting a housing (12A) comprising a coiled or spooled U-shaped fiber optical sensing cable (21) to the wellhead (2) of the well (1) such that an opening (14) in the wall of the housing (12A) is connected to a guide tube (15) extending into the underwater well (1); —inserting the U-shaped nose section (21A) of the fiber optical sensing cable (21) via the opening (14) into the guide tube (15), thereby uncoiling at least part of a pair of substantially parallel sections of the fiber optical sensing cable of which the lower ends are interconnected by the U-shaped nose section; and connecting the upper ends (21B) of the substantially parallel sections of the fiber optical sensing cable to an optical signal transmission and/or receiving unit via e.g. a pair of wet mateable connectors that are connected to a pair of underwater fiber optical transmission cables (14).

12 Claims, 2 Drawing Sheets

U.S. PATENT DOCUMENTS

| | | | | |
|---|---|---|---|---|
| 6,997,256 | B2 * | 2/2006 | Williams et al. | 166/250.03 |
| 7,409,858 | B2 | 8/2008 | Dria et al. | 73/152.33 |
| 2003/0172752 | A1 | 9/2003 | Kluth et al. | 73/866.25 |
| 2004/0047534 | A1 | 3/2004 | Shah et al. | 385/12 |
| 2004/0065439 | A1 | 4/2004 | Tubel et al. | 166/250 |
| 2007/0110355 | A1 * | 5/2007 | Jaaskelainen et al. | 385/12 |

* cited by examiner

METHOD AND SYSTEM FOR INSERTING A FIBER OPTICAL SENSING CABLE INTO AN UNDERWATER WELL

BACKGROUND OF THE INVENTION

The invention relates to a method and system for inserting a fiber optical sensing cable into an underwater well, such as a subsea well.

It is known to insert an optical fiber into a guide tube in an oil and/or gas production well from a fixed platform to monitor the influx profile along the length of the inflow zone of the well. The optical fiber may use the Raman and/or Brillouin effect along the length of the fiber to monitor the temperature and/or pressure distribution along the length of the guide tube, from which information can be derived about the flux, density and/or composition of the well effluents, which may comprise a mixture of crude oil, water and natural gas.

The optical fiber may be pumped into a U-shaped guide tube by a pumping unit which pumps fluid into an upper end of the guide tube, such that the fluid flowing through the guide tube pulls or drags the optical fiber through the guide tube. Each of the upper fiber ends is then, at the surface, manually spliced to the measurement system.

The known fiber installation techniques are not suitable for installation of fiber optical sensing systems in subsea wells via subsea wellheads due to the complexity of handling and pumping the optical fiber, stripping, cleaning and splicing the fiber(s) to the measurement system.

A currently available option to deploy the fiber in a subsea well is to attach a fixed cable in the well at the time of the completion. For wells with an upper/lower completion, wet-mateable fiber optic connectors for downhole use are required, which significantly adds to the cost and complexity with additional expensive rig time.

It is an object of the present invention to provide a method and system for inserting a fiber optical sensing cable into an underwater well in an efficient manner, without requiring the use of an offshore working rig or the presence of a floating or standing offshore platform above the well.

SUMMARY OF THE INVENTION

In accordance with the invention there is provided a method for inserting a fiber optical sensing cable into an underwater well, comprising:

- connecting a housing comprising a coiled fiber optical sensing cable to the wellhead of the well such that an opening in the wall of the housing is connected to a guide tube extending into the underwater well;
- inserting the fiber optical sensing cable via the opening into the guide tube, thereby uncoiling at least part of the fiber optical sensing cable; and
- connecting an upper end of the fiber optical sensing cable to an optical signal transmission and/or receiving unit;
- characterized in that the fiber optical sensing cable is U-shaped and comprises a U-shaped nose section which interconnects a pair of substantially parallel cable sections and that the nose section is inserted to the guide tube such that it pulls at least the lower parts of the substantially parallel cable sections into the guide conduit and that the upper ends of these cable sections are connected to the optical signal transmission and/or receiving unit.

An advantage of inserting a U-shaped fiber optical sensing cable into the guide conduit is that at each location along the section of the guide conduit where the cable is inserted two signal reflections are obtained, which can be compared to each other so that a more accurate reading of one or more sensed parameters, such as temperature and/or pressure, throughout said section of the guide conduit can be obtained.

The coiled U-shaped fiber optical sensing cable may be spooled around a drum mounted on a shaft that is rotatably mounted within the housing such that the U-shaped nose section forms a proximal end at the outer circumference of the spooled cable and the upper ends of the substantially parallel cable sections form a pair of terminal ends at the inner circumference of the spooled cable and the two substantially parallel cable sections are spooled simultaneously from the drum and thereby uncoiled in response to inserting the nose section of the fiber optical sensing cable via the opening into the guide tube.

Alternatively, the two substantially parallel cable sections are coiled within the housing and are uncoiled and pulled by the U-shaped nose section at least partly into the guide conduit in response to inserting the U-shaped nose section of the fiber optical sensing cable into the guide tube.

Optionally, the upper ends of the substantially parallel cable sections are connected to a pair of wet mateable fiber optical sensing cable connectors which are secured to the wall of the housing and wherein a pair of underwater deployable fiber optical transmission cables are connected to the wet mateable fiber optical sensing cable connectors such that the underwater deployable fiber optical transmission cables provide a pair of fiber optical communication links between the wet mateable fiber optical sensing cable connectors and the optical signal transmission and receiving assembly, which is located above the water surface.

The guide tube may be U-shaped and the opening may be connected to the upper end of a first leg of the guide tube, and the upper end of a second leg of the guide tube may be connected to a second opening in the wall of the housing, and the U-shaped nose section and at least the lower parts of the substantially parallel sections of the fiber optical sensing cable that are interconnected by the U-shaped nose section may be pumped down through the first leg of the guide tube towards the U-turn of the guide tube and optionally through the U-turn at least partially up into the second leg of the guide tube.

In such case a pumping unit may extract fluid, such as water, from the second opening and pump the extracted fluid into the first opening such that fluid is recirculated in a closed loop through the U-shaped guide tube.

It is preferred that the U-shaped nose section provides a minibend having an outer width of less than 5 mm, and that the two substantially parallel sections of the U-shaped fiber that are interconnected by the minibend are embedded in a protective coating having an outer width less than 5 mm, preferably less than 1.5 mm, and that the two upper ends of the two substantially parallel cable sections are connected to an optical signal transmission and receiving assembly which alternatingly transmits light pulses into each of the upper ends of the substantially parallel cable sections. The minibend is described in International patent application WO 2005/014976.

Optionally Raman, Rayleigh and or Brillouin optical signals that are backscattered along the length of the U-shaped fiber optical sensing cable extending through the guide tube are monitored in the optical signal transmission and receiving unit and transferred to a production monitoring system in which the monitored signals are converted into production monitoring data, which may include the temperature and/or pressure distribution along at least part of the length the guide tube, from which distribution data relating to the flux and composition of well effluents are derived.

Optionally, the fiber optical sensing cable comprises one or more optical fibers with Fiber Bragg Gratings and the wavelengths of the Fiber Bragg Gratings along the length of the fiber optical sensing cable extending through the guide tube are monitored in the optical signal transmission and receiving unit and transferred to a production monitoring system in which the monitored signals are converted into production monitoring data, which may include the temperature and/or pressure distribution along at least part of the length the guide tube, from which distribution data relating to the flux and composition of well effluents are derived.

The cable may comprise multiple U-shaped optical fibers and the optical fibers may be ribbonized to avoid crossed fibers during cable manufacturing and the associated potential bend and/or stress induced wavelength shift of the Fiber Bragg Gratings.

The invention also relates to a system for inserting a fiber optical sensing cable into an underwater well, comprising a housing comprising a coiled fiber optical sensing cable, which housing is adapted to be connected to the wellhead of the well such that an opening in the wall of the housing is connected to a guide tube extending into the underwater well;

means for inserting a lower end of the fiber optical sensing cable via the opening into the guide tube, thereby uncoiling at least part of the fiber optical sensing cable; and an underwater mateable connector for connecting an upper end of the fiber optical sensing cable to an underwater deployable fiber optical transmission cable; characterized in that the fiber optical sensing cable is U-shaped and comprises a U-shaped nose section which interconnects a pair of substantially parallel cable sections and that the nose section is configured to be inserted to the guide tube such that in use it pulls at least the lower parts of the substantially parallel cable sections into the guide conduit and that the upper ends of these cable sections are connected to a pair of wet mateable fiber optical sensing cable connectors.

These and other features advantages and embodiments of the method and system according to the invention are described in the accompanying claims, abstract and the following detailed description of a preferred embodiment in which reference is made to the accompanying drawings.

DESCRIPTION OF A PREFERRED EMBODIMENT

Figure 1:
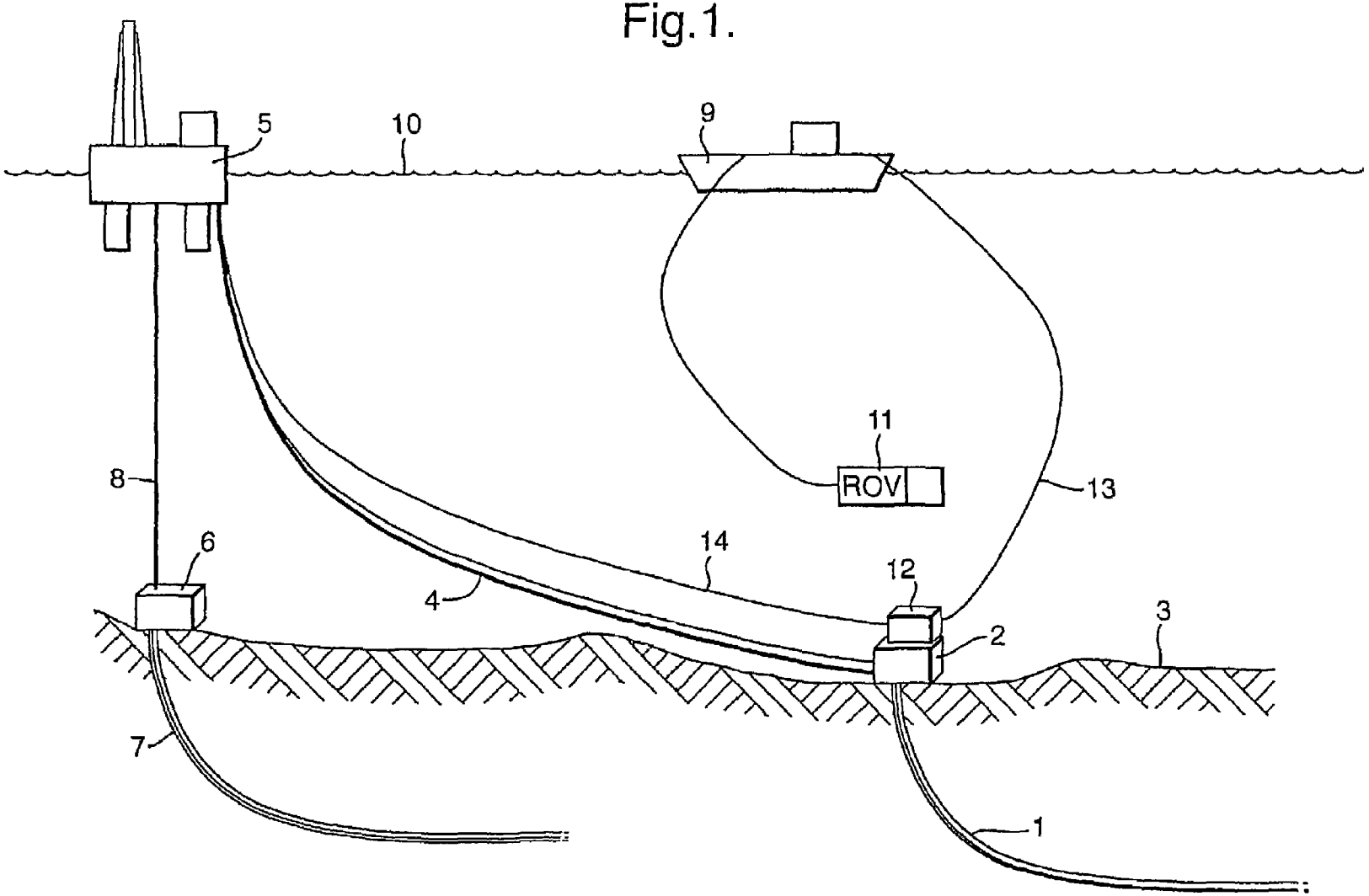
FIG. 1 is a schematic view of an underwater well of which the wellhead is equipped with a U-shaped fiber deployment assembly according to the invention.

FIG. 1 depicts an underwater satellite well 1 of which the wellhead 2 is located at the water bottom 3. A flexible underwater production conduit 4 conveys the produced oil and/or gas from the wellhead 2 to a floating production unit 5, which is connected to the wellhead 6 of a second well 7 via a vertical riser 8.

A workboat 9 floats at the water surface 10 above the satellite well 1, and a Remotely Operated Vehicle or ROV 11 is suspended below the workboat 9, which ROV 11 has been used to connect a fiber deployment assembly 12 to the wellhead 2. An umbilical cable 13 for supplying power to the fiber deployment assembly 12 and for controlling the fiber deployment operations is connected between the assembly 12 and the workboat.

An underwater fiber optical signal transmission cable 14 is arranged between the fiber deployment assembly 12 and the floating production unit 5.

Figure 2:
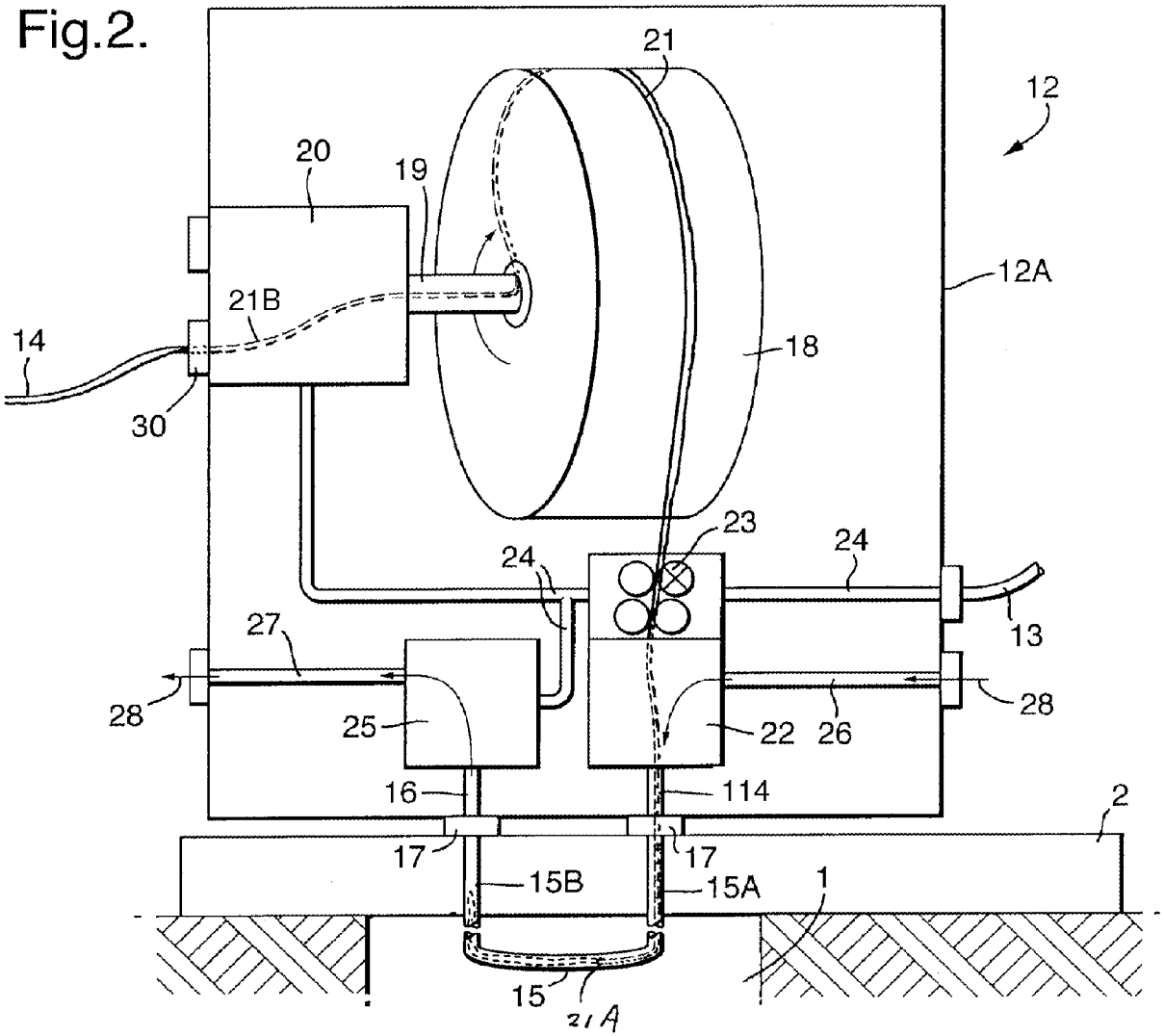
FIG. 2 is a schematic more detailed cross-sectional view of the U-shaped fiber deployment assembly of FIG. 1.

FIG. 2 shows in more detail the wellhead 2 of the satellite well 1 and the fiber deployment assembly 12. The assembly 12 comprises a watertight housing 12A, which is coupled to the wellhead 2 by a stab-in connector (not shown) such that a first opening 114 formed in the wall of the housing 12A is connected to the upper end of a first leg 15A of a U-shaped guide tube 15 and that a second opening 16 formed in the wall of the housing 12A is connected to the upper end of a second leg 15B of the U-shaped guide tube. A pair of seals 17 is arranged adjacent to the openings 114 and 16.

A fiber spooling drum 18 is mounted on a support shaft 19, which is rotatably mounted within the housing 12A.

The shaft 19 is provided with a motor and/or brake unit 20, which controls the rotation of the drum 18. An elongate U-shaped fiber optical sensing cable 21 is spooled around the drum 18 such that a U-shaped nose section 21A and the lower parts of a pair of elongate substantially parallel cable sections that are interconnected by the U-shaped nose section 21A extend into the guide conduit 15. The U-shaped fiber optical sensing cable 21 is guided from the drum 18 into a first fiber pumping unit 22 by means of a series of guide wheels 23.

Power supply and control lines 24 are connected to the guide wheels 23, to the motor and/or brake unit 20, to the first pumping unit 22 and to a second pumping unit 25.

The first pumping unit 22 is connected to a water inlet conduit 26 via which water is pumped into the opening 14 and U-shaped guide conduit 15 and the second pumping unit is connected to a water outlet conduit 27 via which water is discharged from the U-shaped guide conduit 15 back into the sea as illustrated by arrows 28.

The flux of water that is pumped via the first opening 14 into the guide tube 15 will pull the U-shaped nose section 21A of the fiber optical sensing cable 21 into the guide tube 15. The rotation of the drum 18 is controlled by the motor and/or braking unit 20 and the rotation of the guide wheels 23 are controlled in conjunction with the water velocity pumped through the guide tube 15 by the pumping units 22 and 25 such that the two substantially parallel sections of the fiber optical sensing cable 21 are smoothly inserted into the guide tube 15 without causing large tension and or compression stresses in the two substantially parallel sections of the fiber optical sensing cable 21 thereby inhibiting the risk of and/or buckling of the cable 21 during the installation procedure.

The upper ends 21B of the two substantially parallel sections of the fiber optical sensing cable 21 are rotatably connected to a pair of wet mateable fiber optical sensing cable connectors 30 into which a pair of underwater fiber optical transmission cables 14 are plugged.

The U-shaped fiber optical sensing cable 21 extending through the guide conduit 15 may be used to monitor the temperature and/or pressure within the guide conduit 15 and/or the surrounding well 1. The U-shaped fiber optical sensing cable 21 may be provided with fiber-bragg gratings for making a series of accurate temperature and/or pressure measurements at selected locations along the length of the fiber optical sensing cable. Alternatively the Raman and/or Brillouin peaks of light pulses that are backscattered at each point along the length of the U-shaped fiber optical sensing cable 21 may be used in conjunction with the time of flight of the backscattered light pulses to obtain information about the temperature and/or pressure along the entire length of the U-shaped cable 21. The temperature and/or pressure of the gas in the interior of the housing 12A may be monitored and/or controlled to provide a known temperature and/or pressure for the upper parts of the substantially parallel sections of the fiber optical sensing cable 21 which remain spooled around the drum 18, which may be used as a reference for the temperature and/or temperature data derived from the backscattered light pulses.

The invention claimed is:

1. A method for inserting a fiber optical sensing cable into an underwater well, comprising connecting a housing comprising a coiled fiber optical sensing cable to the wellhead of the well such that an opening in the wall of the housing is connected to a guide tube extending into the underwater well;

inserting a lower end of the fiber optical sensing cable via the opening into the guide tube, thereby uncoiling at least part of the fiber optical sensing cable; and connecting an upper end of the fiber optical sensing cable to an optical signal transmission or receiving unit;

wherein the lower end of the fiber optical sensing cable is U-shaped and comprises a U-shaped nose section which interconnects a pair of substantially parallel cable sections having upper and lower ends, wherein the nose section is inserted into the guide tube such that the nose section pulls at least the lower ends of the substantially parallel cable sections into the guide tube, and wherein the upper ends of the cable sections are connected to the optical signal transmission or receiving unit; and wherein the guide tube is U-shaped and the opening is connected to the upper end of a first leg of the guide tube, and wherein the upper end of a second leg of the guide tube is connected to a second opening in the wall of the housing, and wherein the U-shaped nose section and at least the lower parts of the substantially parallel sections of the fiber optical sensing cable that are interconnected by the U-shaped nose section are pumped down through the first leg of the guide tube towards a U-turn of the guide tube and through the U-turn at least partially up into the second leg of the guide tube.

2. The method of claim 1, wherein the shaft is connected to a motor which induces the two substantially parallel fiber optical sensing cable sections to be spooled from the drum at a controlled speed, which speed is substantially similar to the speed at which the lower end of the fiber optical sensing cable is pumped into the guide tube.

3. The method of claim 1, wherein the two substantially parallel cable sections are coiled within the housing and are uncoiled and pulled by the U-shaped nose section at least partly into the guide conduit in response to inserting the U-shaped nose section of the fiber optical sensing cable into the guide tube.

4. The method of claim 1, wherein the upper ends of the substantially parallel fiber optical sensing cable sections are connected to a pair of wet mateable fiber optical sensing cable connectors which are secured to the wall of the housing and wherein a pair of underwater deployable fiber optical transmission cables are connected to the wet mateable fiber optical sensing cable connectors such that the underwater deployable fiber optical transmission cables provide a pair of fiber optical communication links between the wet mateable fiber optical sensing cable connectors and the optical signal transmission and receiving assembly, which is located above the water surface.

5. The method of claim 1, wherein a pumping unit extracts fluid from the second opening and pumps the extracted fluid into the first opening such that fluid is recirculated in a closed loop through the U-shaped guide tube.

6. The method of claim 1, wherein the second opening is connected to a second pumping unit and wherein the second pumping unit pumps a flux of fluid from the second leg of the guide tube which is substantially similar to a flux of fluid which is pumped by the other pumping unit into the first leg of the guide tube.

7. The method of claim 6, wherein the other pumping unit pumps water into the guide tube and the second pumping unit extracts the injected water from the guide tube and discharges the extracted water into the body of water surrounding the housing.

8. The method of claim 1, wherein the fiber optical sensing cable U-shaped nose section provides a minibend having an outer width of less than about 5 mm, the two substantially parallel sections of the U-shaped fiber that are interconnected by the minibend are embedded in a protective coating having an outer width less than about 5 mm and wherein the two upper ends of the two substantially parallel cable sections are connected to an optical signal transmission and receiving assembly which alternatingly transmits light pulses into each of the upper ends of the substantially parallel cable sections.

9. The method of claim 8, wherein Ramãn, Rayleigh and or Brillouin optical signals that are backscattered along the length of the U-shaped fiber optical sensing cable extending through the guide tube are monitored in the optical signal transmission and receiving unit and transferred to a production monitoring system in which the monitored signals are converted into production monitoring data, which may include the temperature or pressure distribution along at least part of the length the guide tube, from which distribution data relating to the flux and composition of well effluents are derived.

10. The method of claim 1, wherein the fiber optical sensing cable comprises one or more optical fibers with Fiber Bragg Gratings and the wavelengths of the Fiber Bragg Gratings along the length of the fiber optical sensing cable extending through the guide tube are monitored in the optical signal transmission and receiving unit and transferred to a production monitoring system in which the monitored signals are converted into production monitoring data, which may include the temperature or pressure distribution along at least part of the length the guide tube, from which distribution data relating to the flux and composition of well effluents are derived.

11. The method of claim 10, wherein the cable comprises multiple U-shaped optical fibers and the optical fibers are ribbonized to avoid crossed fibers during cable manufacturing and the associated potential bend or stress induced wavelength shift of the Fiber Bragg Gratings.

12. A system for inserting a fiber optical sensing cable into an underwater well, comprising a housing comprising a coiled fiber optical sensing cable, which housing is adapted to be connected to the wellhead of the well such that an opening in the wall of the housing is connected to a guide tube extending into the underwater well;

means for inserting a lower end of the fiber optical sensing cable via the opening into the guide tube, thereby uncoiling at least part of the fiber optical sensing cable;

underwater mateable connectors for connecting an upper end of the fiber optical sensing cable to an optical signal transmission or receiving unit;

wherein the lower end of the fiber optical sensing cable is U-shaped and comprises a U-shaped nose section which interconnects a pair of substantially parallel cable sections having upper and lower ends, wherein the nose section is inserted into the guide tube such that in use the nose section pulls at least the lower ends of the substantially parallel cable sections into the guide tube, and wherein the upper ends of the cable sections are connected to the of wet mateable fiber optical sensing cable connectors; and wherein the guide tube is U-shaped and the opening is connected to the upper end of a first leg of the guide tube, and wherein the upper end of a second leg of the guide tube is connected to a second opening in the wall of the housing, and wherein the U-shaped nose section and at least the lower parts of the substantially parallel sections of the fiber optical sensing cable that are interconnected by the U-shaped nose section are pumped down through the first leg of the guide tube towards a U-turn of the guide tube and through the U-turn at least partially up into the second leg of the guide tube.

* * * * *